US007543968B2

(12) United States Patent
Chen

(10) Patent No.: US 7,543,968 B2
(45) Date of Patent: Jun. 9, 2009

(54) ROTATING STRUCTURE FOR FOLDING SUPPORTS OF A LAMP

(75) Inventor: Meiric Chen, Hsin Chuang (TW)

(73) Assignee: Seed Lighting Design Co., Ltd., Hsin Chuang, Taipei Hsien (TW)

( * ) Notice: Subject to any disclaimer, the term of this patent is extended or adjusted under 35 U.S.C. 154(b) by 0 days.

(21) Appl. No.: 11/842,956

(22) Filed: Aug. 22, 2007

(65) Prior Publication Data

US 2009/0052196 A1 Feb. 26, 2009

(51) Int. Cl.
*F21S 8/00* (2006.01)

(52) U.S. Cl. ..... 362/427; 362/406; 362/418

(58) Field of Classification Search ..... 362/405, 362/406, 408, 413, 418, 419, 427, 428
See application file for complete search history.

(56) References Cited

U.S. PATENT DOCUMENTS 5,446,631 A * 8/1995 Chikada ..... 362/463
5,996,819 A * 12/1999 Klein ..... 211/85.14
7,001,050 B2 * 2/2006 Beasley et al. ..... 362/414

* cited by examiner

*Primary Examiner*—John A Ward

(57) ABSTRACT

A rotating structure for folding supports of a lamp comprises a rotating axle having at least a support, and a fixed axle disposed in relation to the rotating axle, the fixed axle also includes at least a support thereon; a trough and an elastic positioning component disposed at a joined surface between the rotating axle and the fixed axle, so that the rotating axle causes that at least a support move positionally. As a result, the supports of the lamp of the invention is rotatable and is folded for storage, or unfolded for use.

10 Claims, 13 Drawing Sheets

ROTATING STRUCTURE FOR FOLDING SUPPORTS OF A LAMP

FIELD OF THE INVENTION

The invention relates to supports of lamps, and particularly to a rotating structure having axles with rotating mechanisms for folding and unfolding supports thereof.

DESCRIPTION OF PRIOR ART

As the quality of life continues to improve, many indoor designers are putting more emphasis on the development of new products, and one of which is related to the application of lights. In regard to indoor lighting, new options for light sources and lights are constantly arriving, and the means of emphasizing atmosphere like direct or indirect lighting may be used alternatively to present a variety of settings. Among the various lightings, ordinary desk lamps, standing lamps, or hanging lights are similar in their basic structure; in which a cover made of various fabrics or glass is installed on a support on top of a standing pole, and a light bulb is placed at center of the cover, which allows light emitted from the light bulb to permeate into the surroundings. The major advantage of such lighting is that they are easy to carry around, and may be placed into anywhere background lighting is required, or anywhere that needs more emphasis or coverage. Overall, lighting and lighting devices not only provide partial illumination, but also bring aesthetic touches to all indoor areas where they are added.

Although the lighting devices may be used to create atmosphere, when it becomes necessary to clean or put away the lighting devices, the following disadvantages arise:

1. Dirt and dust from the environment often accumulate on the lighting devices, and because the cover and the supports of the lighting devices are hard to separate from other parts, it can make the lighting devices difficult to clean, or virtually impossible to reach the inside of the lighting devices for more thorough cleaning.
2. The supports of the lighting devices are structurally fixed, even though it is possible to separate the supports from the standing pole for storage, the supports are the parts that take up a lot of physical space, which makes the supports inconvenient to carry around or put away not only for manufacturers, but also vendors and consumers.

SUMMARY OF THE INVENTION

A rotating structure is proposed in the invention, which allows supports of a lamp to be rotated and folded for putting away, or unfolded for use; so that the size of the lamp may be adjusted freely for easy storage, and thus the lamp may take up less physical space during transportation and in stock, which helps reduce costs.

The advantages of the rotating structure of the invention:

1. A rotating axle is used to allow supports of a lamp to be separated from a cover, which not only makes it easy to clean the different parts of the lamp, but also allows the parts to be conveniently assembled together again.
2. The supports of the lamp according to the invention may be stacked together and put away in order to save more physical space for storage, and thus the manufacturers may conveniently carry around or store the lamp, and so may the vendors and the consumers.

To achieve above object, the present invention provides a rotating structure for folding supports of a lamp being able to rotate and positionally move at least a support, comprising: a rotating axle having at least a support extended therefrom, and a trough with an elastic positioning component disposed therein; a fixed axle having at least a support extended therefrom, and at least a positioning point; wherein the rotating axle and the fixed axle joins and forms a joined surface, and the elastic positioning component and the positioning point are disposed within the joined surface.

Furthermore the present invention provides a rotating structure for folding supports of a lamp being able to rotate and positionally move at least a support, comprising: a fixed axle having at least a support extended therefrom, and a trough with an elastic positioning component disposed therein; a rotating axle having at least a support extended therefrom, at least a positioning point, a through opening correspondingly disposed to the positioning point, and an elastic component secured in the through opening with a fixing component; a pin partially disposed in the through opening of the rotating axle; wherein the rotating axle and the fixed axle joins and forms a joined surface, and the pin can press against the ball, so that the ball is removed from the positioning point by the pin, and the rotating axle subsequently allows the support to rotate.

Moreover the present invention provides a rotating structure for folding supports of a lamp being able to rotate and positionally move at least a support, comprising: a fixed axle having at least a support extended therefrom, and an opening; an elastic plate having a knob at a front end thereof, and the knob being exposed from the opening of the fixed axle; a rotating axle having at least a support extended therefrom, at least a positioning point, a through opening correspondingly disposed to the positioning point, and an elastic component secured in the through opening with a fixing component; a pin partially disposed in the through opening of the rotating axle; wherein the rotating axle and the fixed axle joins are formed with a joined surface, and the pin can press against the knob of the elastic plate, so that the knob is removed from the positioning point by the pin, and the rotating axle subsequently causes the support to rotate.

BRIEF DESCRIPTION OF DRAWINGS

The structure and the technical means adopted by the present invention to achieve the above and other objectives can be best understood by referring to the following detailed description of the preferred embodiments and the accompanying diagrams, wherein.

DETAILED DESCRIPTION OF PREFERRED EMBODIMENTS

Figure 1:
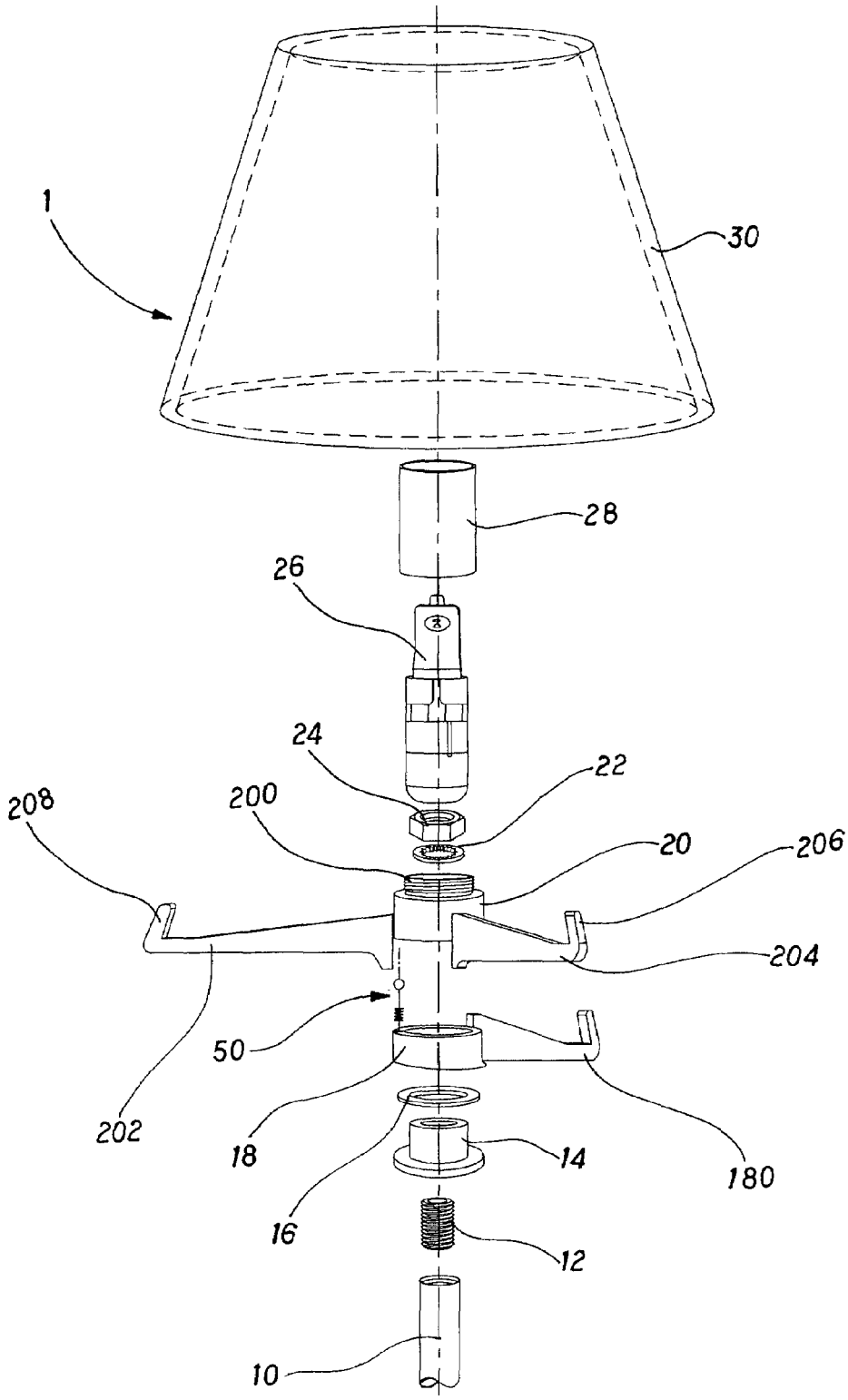
FIG. 1 is an exploded view that shows parts of a lamp according to the invention.
Figure 2:
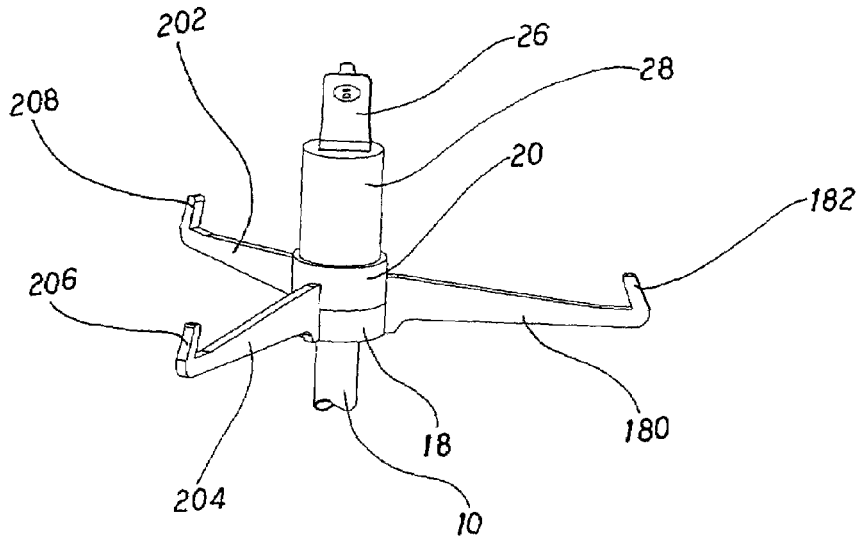
FIG. 2 is a schematic view that shows supports of the lamp being assembled together.
Figure 3:
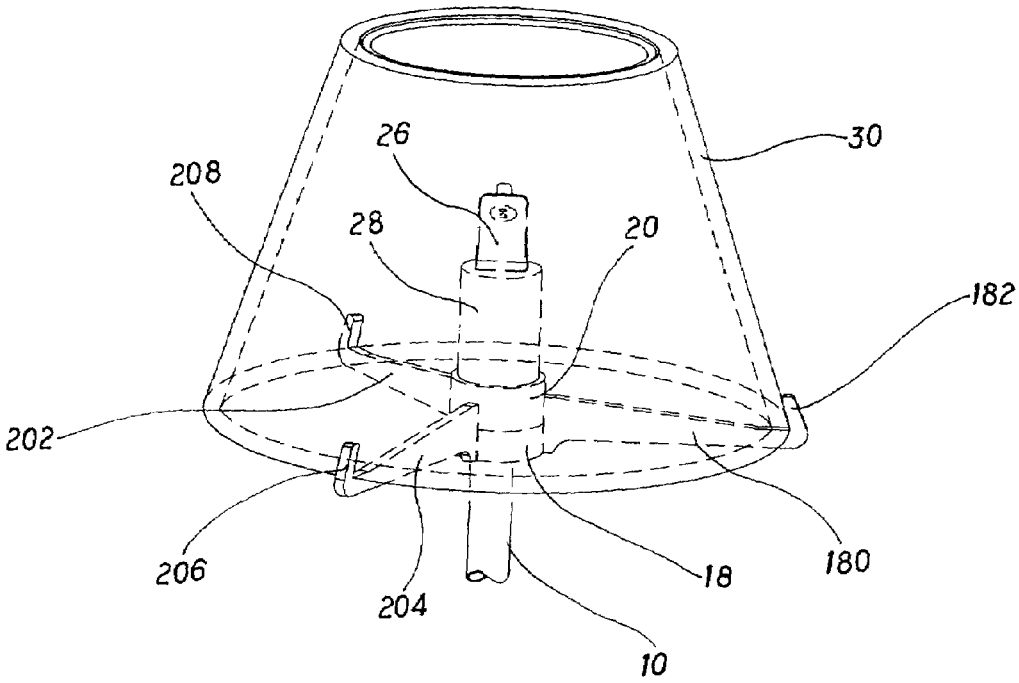
FIG. 3 is a perspective view that shows the supports being assembled with a cover of the lamp.

Referring to FIG. 1, which is an exploded view that shows parts of a lamp according to the invention, which includes a pipe 10 having a tube 12 disposed therein; the tube 12 has a lower cap 14, a washer 16, a rotating axle 18, and a fixed axle 20 sequentially fitted and secured thereon by using an inner teeth washer 22 and a nut 24. A light bulb 26 is placed on top of the fixed axle 20 and secured thereto by using a crown cover 28 and an outer teeth portion 200 of the fixed axle 20. A lamp 1 is obtained by assembling a cover 30 with supports 180, 202, and 204. The lamp of the invention is characterized in that the rotating axle 18, the fixed axle 20, and an elastic positioning component 50 connected to the aforesaid two axles may be rotated in order to put away or realign the support 180, so as to adjust the size of the lamp and facilitate the storage thereof. Referring to FIGS. 2 and 3; wherein FIG. 2 is a schematic view that shows the parts of the lamp from FIG. 1 being assembled together, which results in a shelf having three supports 180, 202, and 204; in which at least a support 180 may be rotated and put away. When the supports are realigned, the cover 30 may be placed onto the supports 180, 202, and 204 by using the supports 180, 202, and 204 and positioning structures thereof; as shown in FIG. 3. The positioning structures are usually fashioned into hooks 182, 206, and 208 as depicted in the drawings, though it is also possible to make grooves on the supports 180, 202, and 204 to achieve the same purpose, or have the supports 180, 202, and 204 segmented so as to position and hold covers of different sizes.

Figure 4:
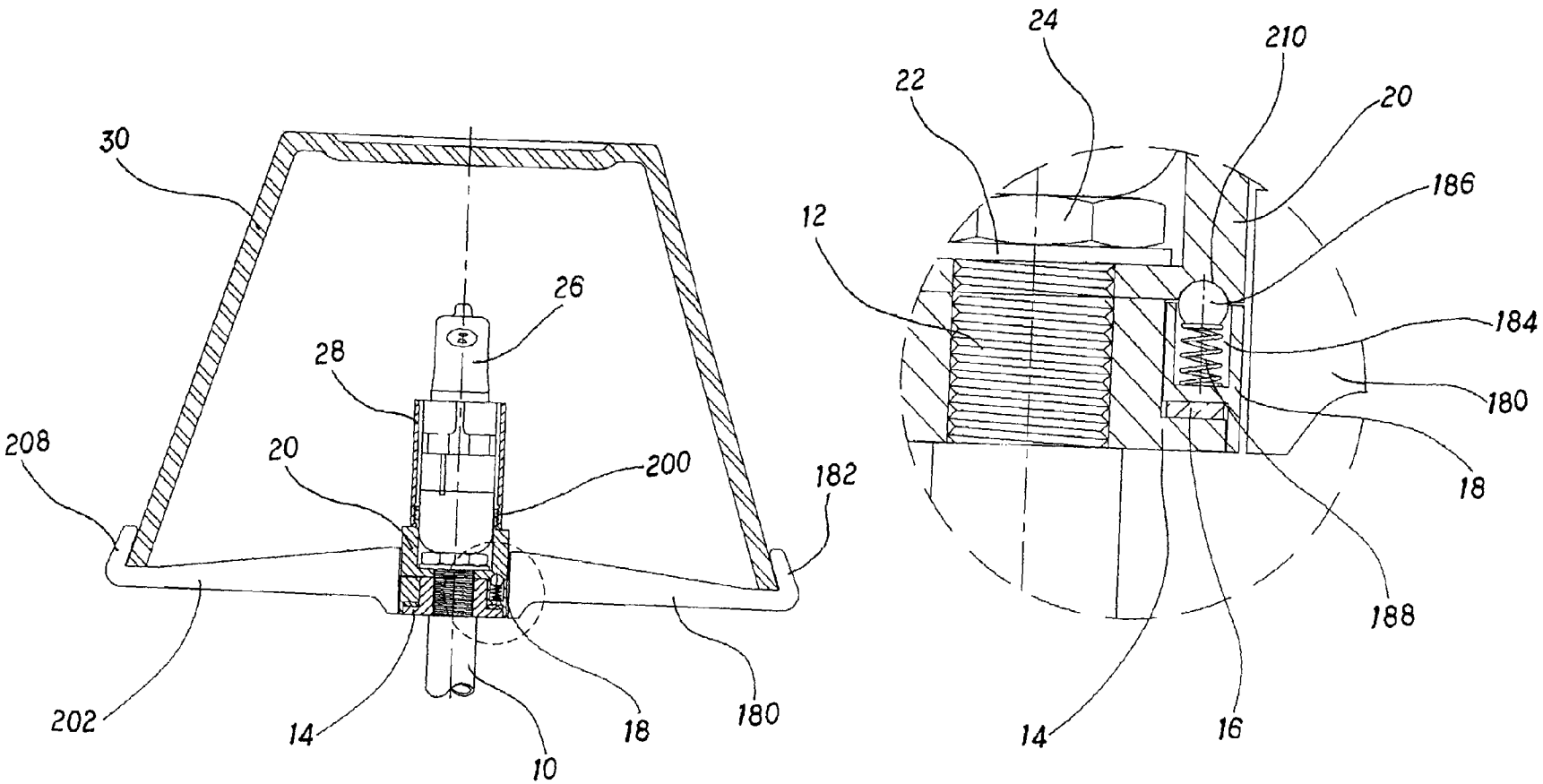
FIG. 4 is an enlarged view that partially shows the supports of the lamp.
Figure 5:
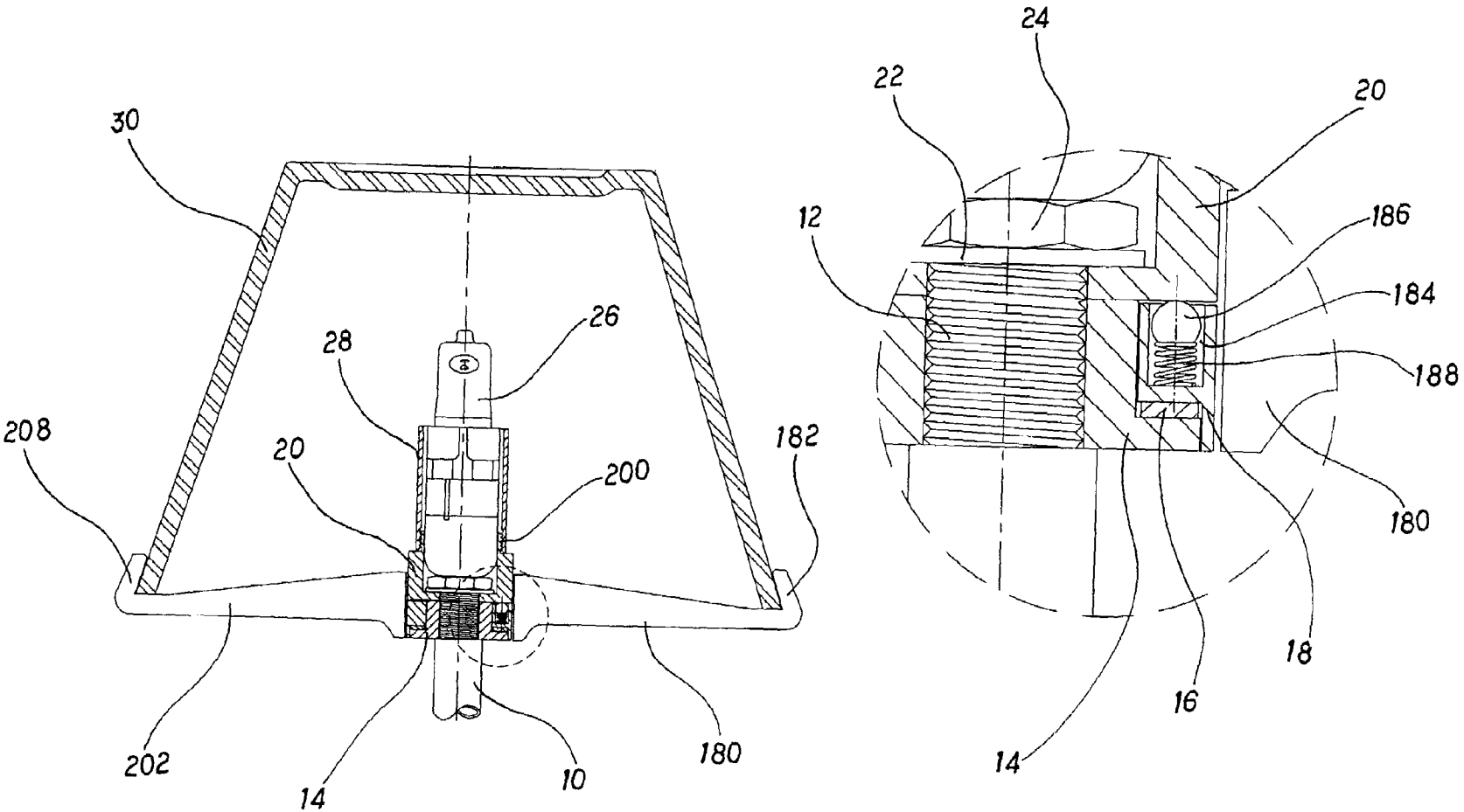
FIG. 5 is an enlarged view that partially shows a support of the lamp being rotated.

Referring to FIGS. 4 and 5, which are views that show a rotating structure for folding supports of a lamp according to a preferred embodiment of the invention, which comprises a rotating axle 18 having at least a support 180 extended outwardly, and a fixed axle 20 disposed relative to the rotating axle 18. A trough 184 and an elastic positioning component 50 are disposed on the rotating axle 18 where it joins the fixed axle 20, so as to allow the rotating axle 18 to rotate and positionally move at least one support 180. In this preferred embodiment, the elastic positioning component 50 is comprised of a ball 186 and a spring 188 disposed in the trough 184, and may also be selected from elastic plastics or rubber. When the lamp is in use, the supports 180 and 202 are unfolded, and the spring 188 in the trough 184 of the rotating axle 18 elastically presses against the ball 186, so that the ball 186 is embedded into a positioning point 210 of the fixed axle 20 (as shown in FIG. 4); so that the supports 180 and 202 are unfolded for use. On the other hand, when the supports 180 and 202 are rotated and folded together, the ball 186 is removed from the positioning point 210 and pressed into the trough 184 by the fixed axle 20. When the ball 186 is removed from the positioning point 210 (as shown in FIG. 5), the support 180 may be rotated by rotating the rotating axle 18, subsequently allowing the support 180 to be put away for storage. Therefore, by fittingly disposing the rotating axle 18 onto the lower cap 14, rotating the rotating axle 18 allows the support 180 to be rotated as well. Alternatively, the fixed axle in the preferred embodiment may be replaced with a rotating axle in order to obtain the function of rotating.

Figure 6A:
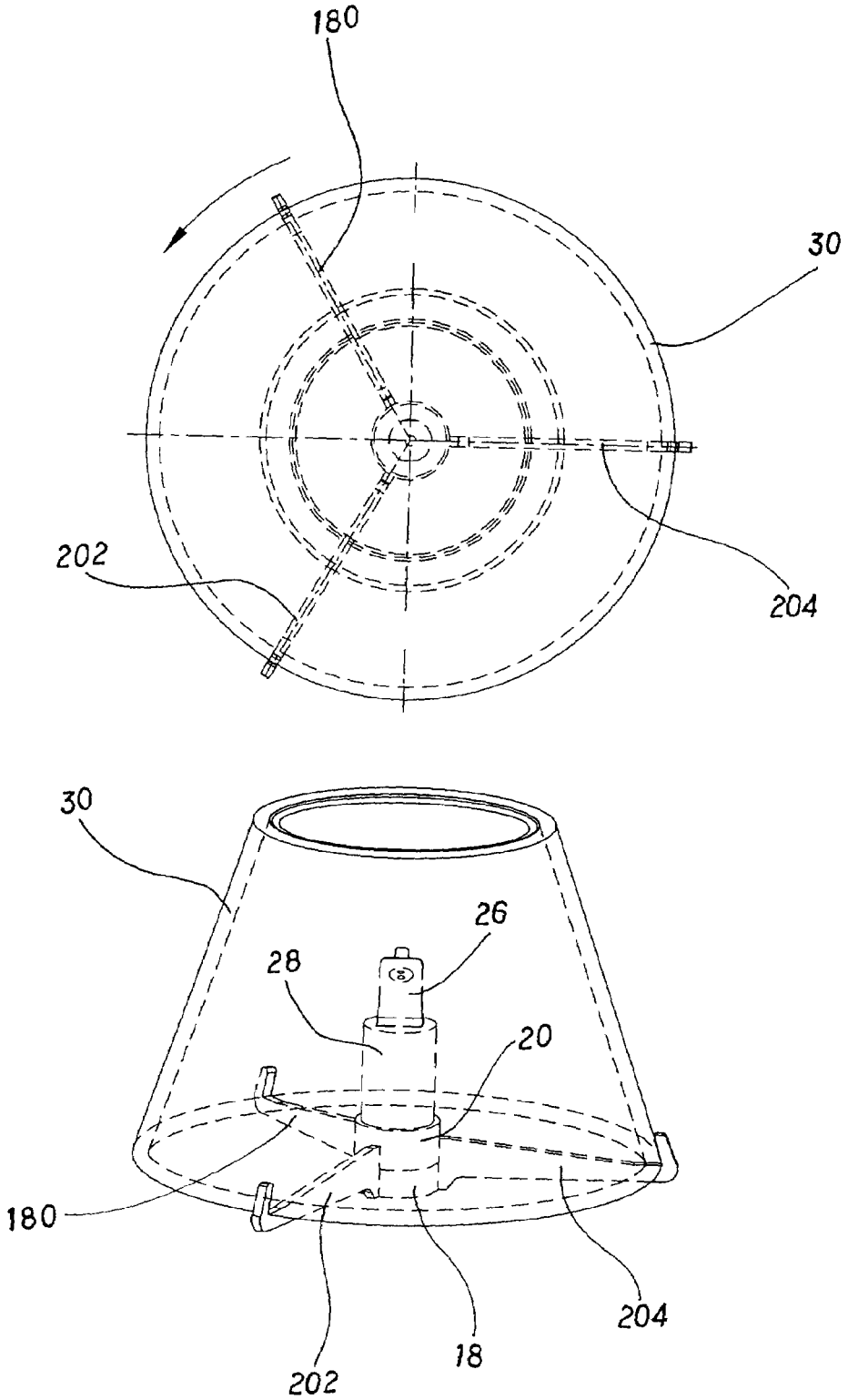
FIGS. 6A and 6B are schematic views that show the supports of the lamp being rotated and put away.
Figure 6B:
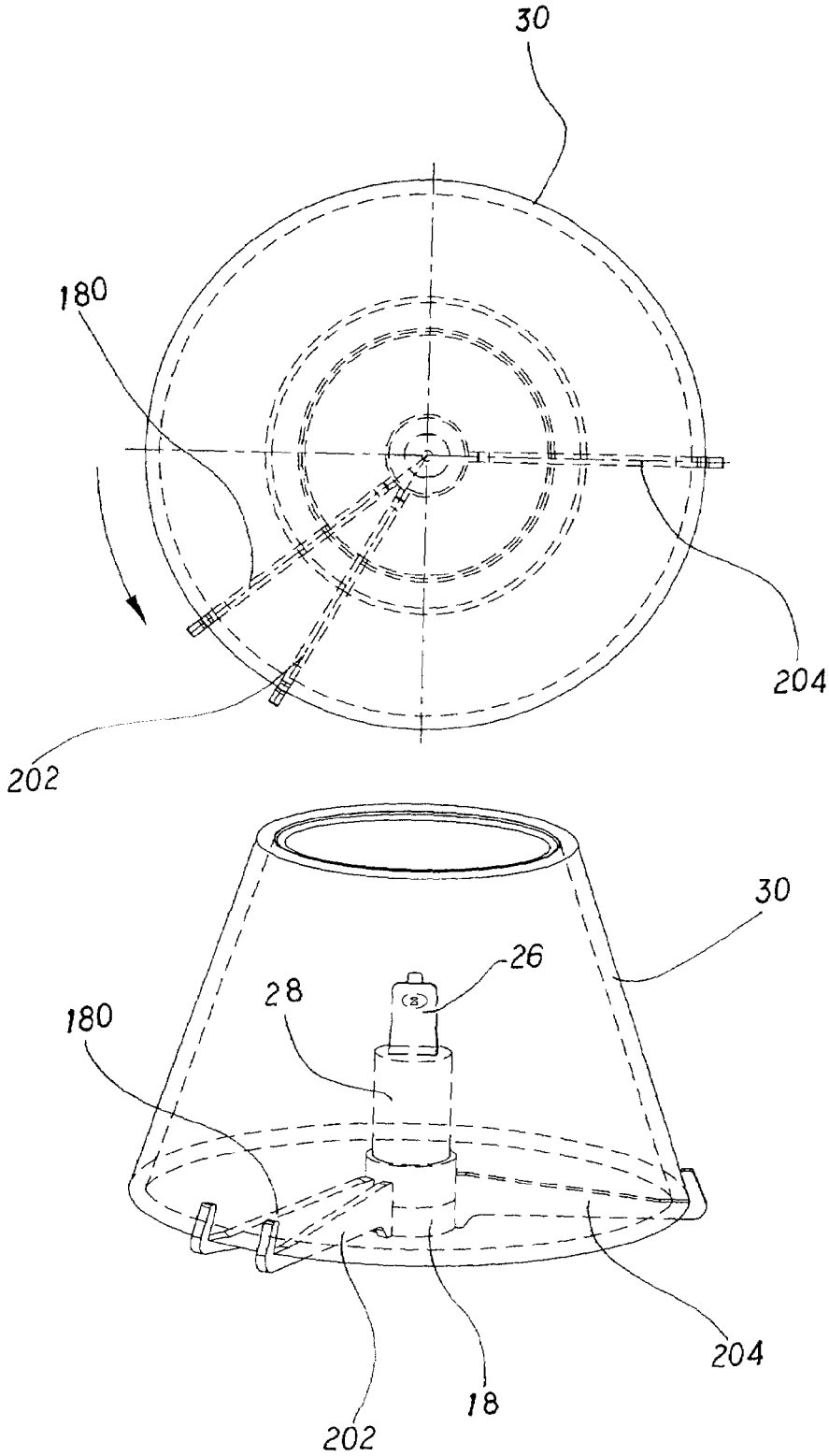

As described previously, the trough 184, the ball 186, and the spring 188 may be selectively disposed at where a surface of the rotating axle 18 joins a surface of the fixed axle 20. For example, if the aforesaid trough 184 is disposed on the rotating axle 18, the ball 186 and the spring 188 would both be disposed in the trough 184, while a positioning point 210 would be correspondingly disposed on the fixed axle 20; or vice versa. Referring to FIGS. 6A and 6B, wherein the process of rotating and putting away the support may be clearly observed. FIGS. 4 and 6A should be read together because both show the supports being unfolded for use, whereas FIGS. 5 and 6B should be read together because both show the supports being folded for storage.

Figure 7:
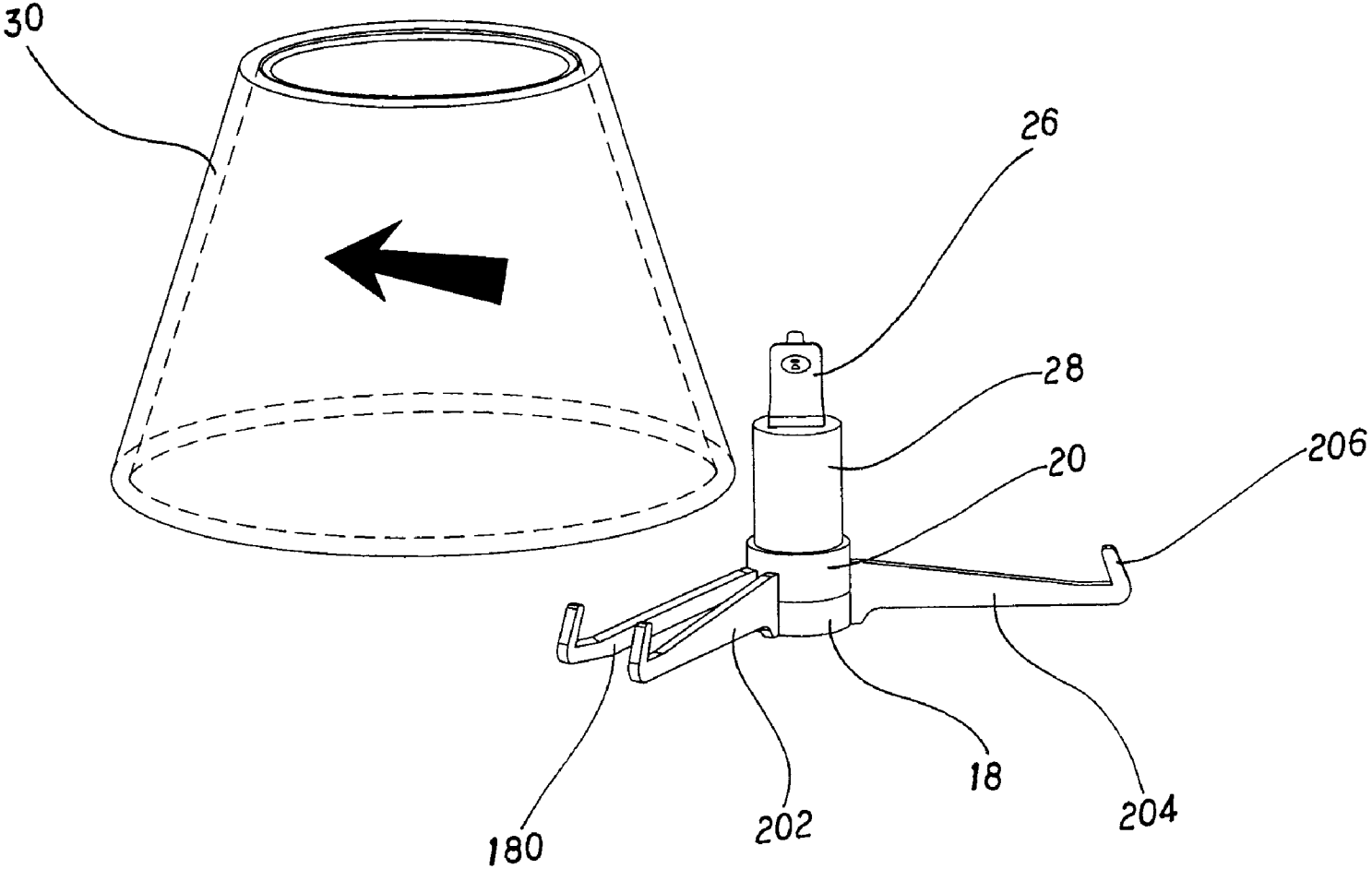
FIG. 7 is a schematic view that shows the separation of the cover from the supports of the lamp.

As indicated in FIG. 6B, when the support 180 of the rotating axle 18 is rotated, the support 180 is moved toward the support 202 of the fixed axle 20, thus allowing the cover 30 originally placed on the supports 180, 202, and 204 to be easily removed by tilting the cover 30 toward a direction unimpeded with any of the supports, as shown in FIG. 7, and without needing to disassemble any parts of the lamp.

Figure 8:
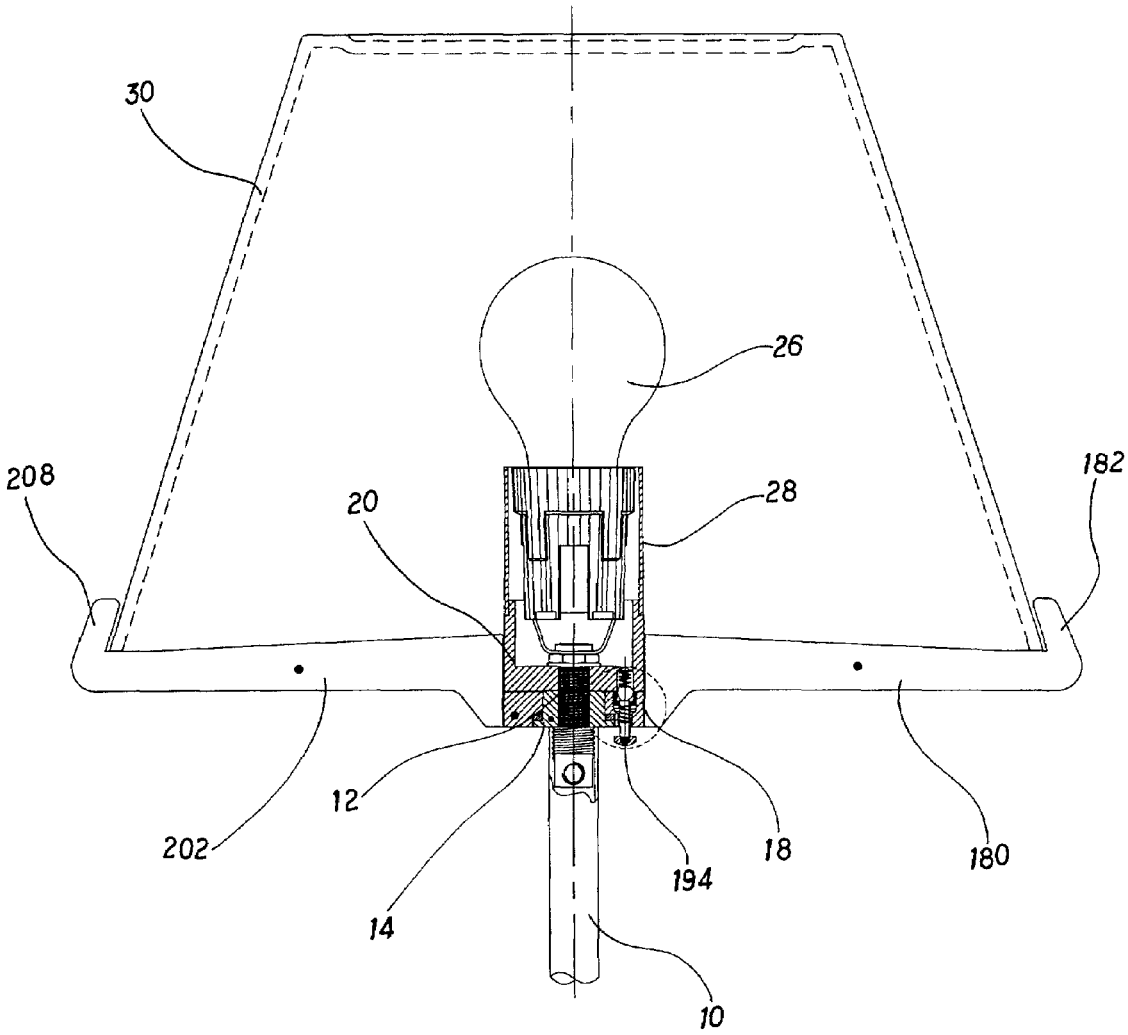
FIG. 8 is a perspective view that shows the combination of the cover and the supports of the lamp according to another preferred embodiment of the invention.
Figure 9:
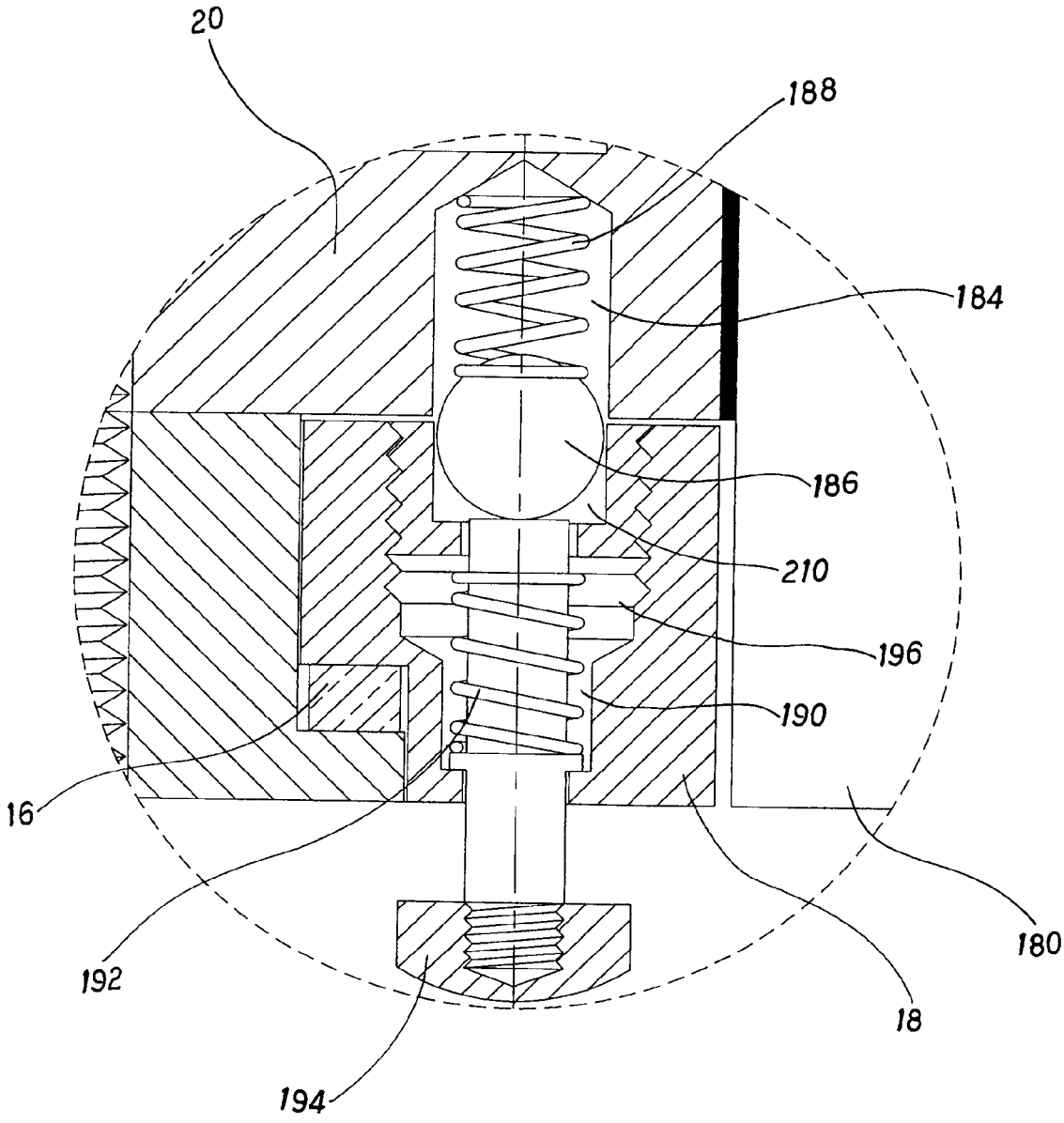
FIG. 9 is an enlarged view that shows a part of the support of the lamp according to yet another preferred embodiment of the invention.

The aforesaid preferred embodiment may be applied on lamps of various sizes and specifications; however, since the support and cover of larger lamps may be relatively longer or heavier, an external force may be required for pressing the ball into the trough, and thus an auxiliary device may be needed for this purpose. Referring to FIGS. 8 and 9, which show a rotating structure for folding supports of a lamp according to another preferred embodiment of the invention; contrary to the previous embodiment, the trough 184, the ball 186, and the spring 188 are disposed on the fixed axle 20, and the positioning point 210 is disposed on the rotating axle 18. Moreover, a through opening 190 is correspondingly disposed to the positioning point 210, and an elastic component 192 is fitted into the through opening 190 with the use of a fixing component 196; a pin 194 may be used in combination with the elastic component 192, so that the pin 194 presses the ball 186 away from the positioning point 210, subsequently allowing the rotating axle 18 to rotate the support 180.

Figure 10:
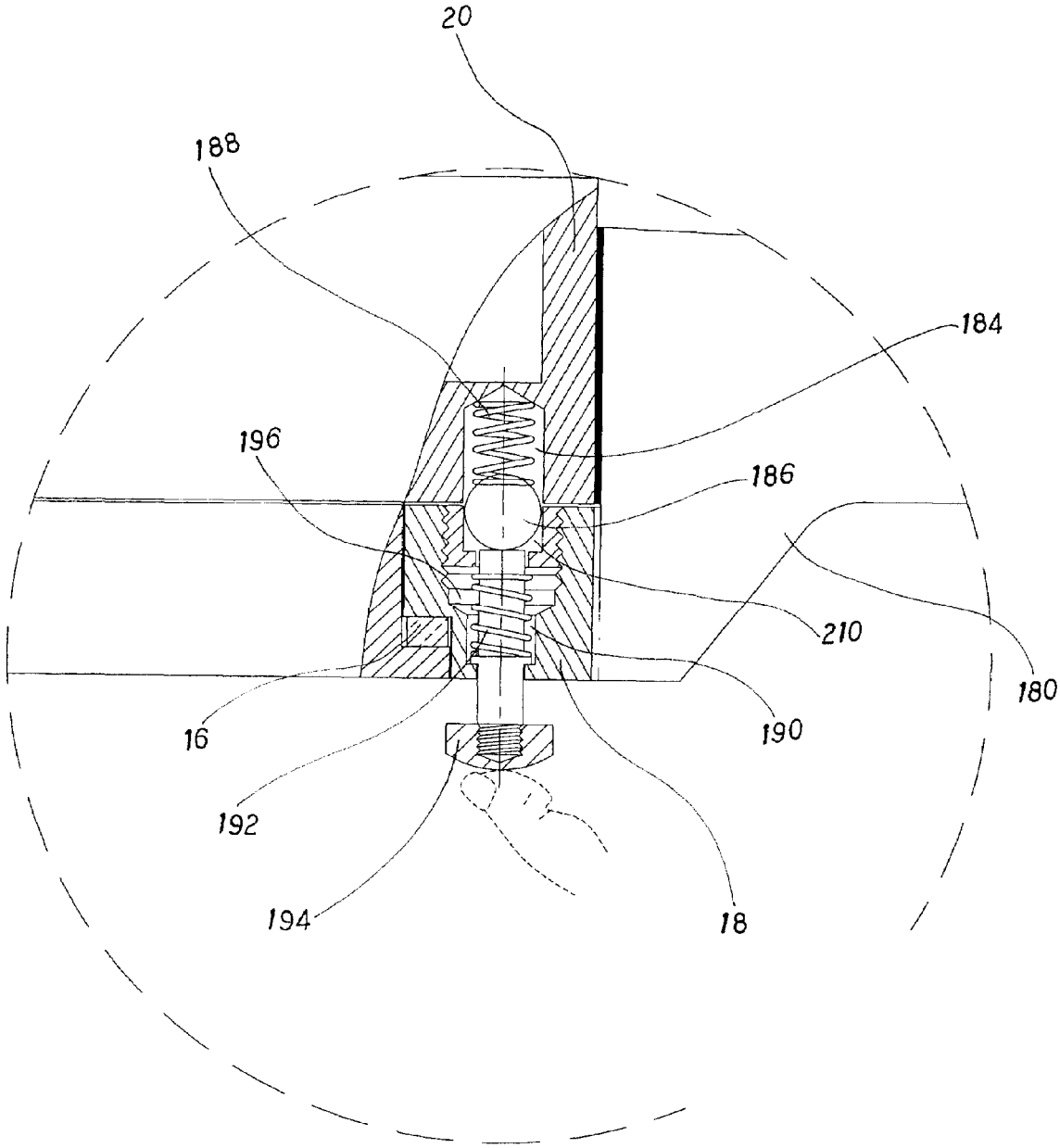
FIG. 10 is an enlarged view that shows a support of the lamp being rotated according to still another preferred embodiment of the invention.
Figure 11:
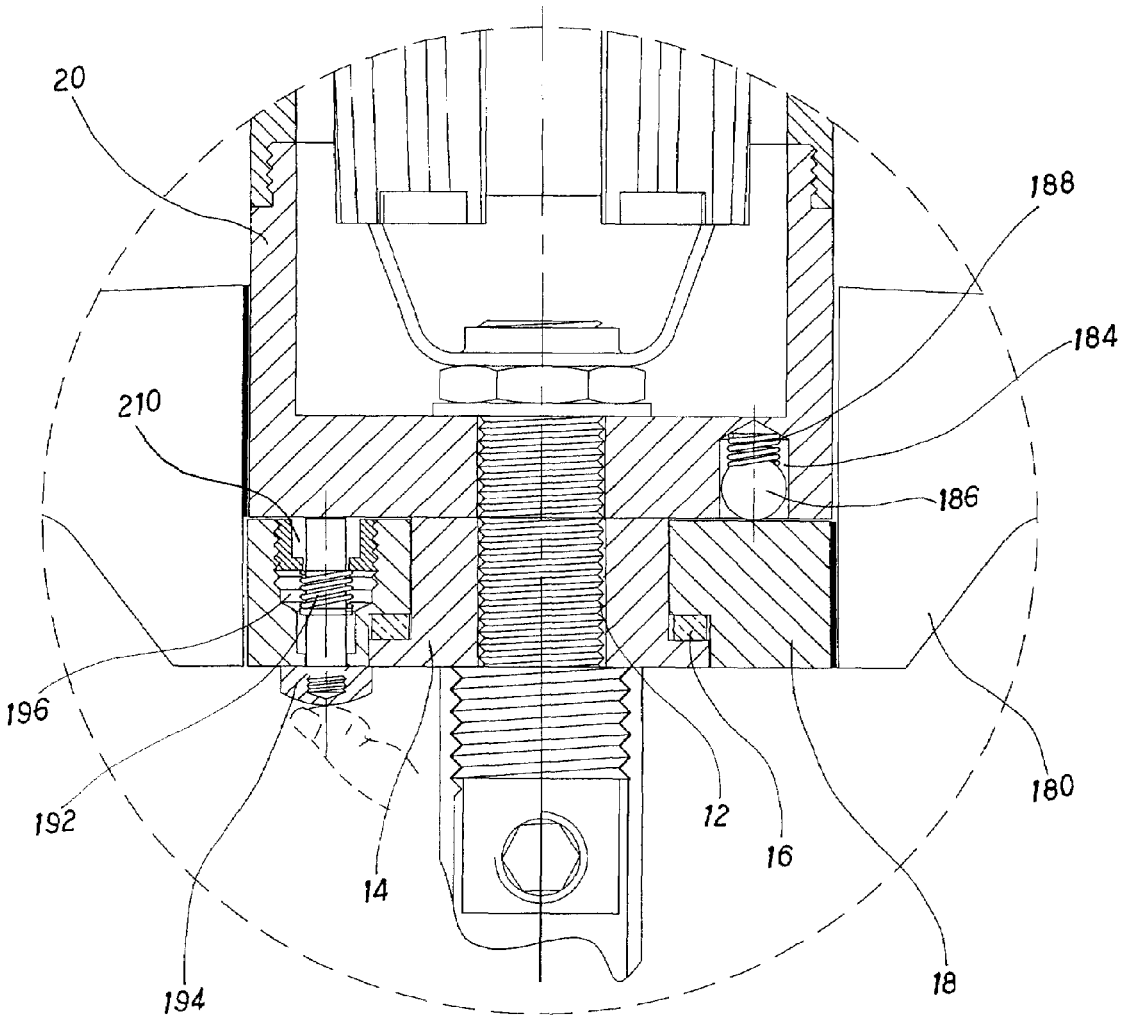
FIG. 11 is an enlarged view that shows the parts of the support that allow for rotation in FIG. 10.

FIGS. 10 and 11 show the lamp in actual usage; when a user presses the pin 194 outside of the rotating axle 18, the pin 194 is pressed upward and in turn pushes against the elastic component 192 in the through opening 190, and the pin 194 also pushes against the ball 186 at the same time, and the ball 186 is pushed away from the positioning point 210 and subsequently pushes the spring 188 into the trough 184 of the fixed axle 20, once the rotating axle 18 becomes free to move, the rotating axle 18 allows the support 180 to rotate as well, and thus entering the status indicated in FIG. 11.

Figure 12:
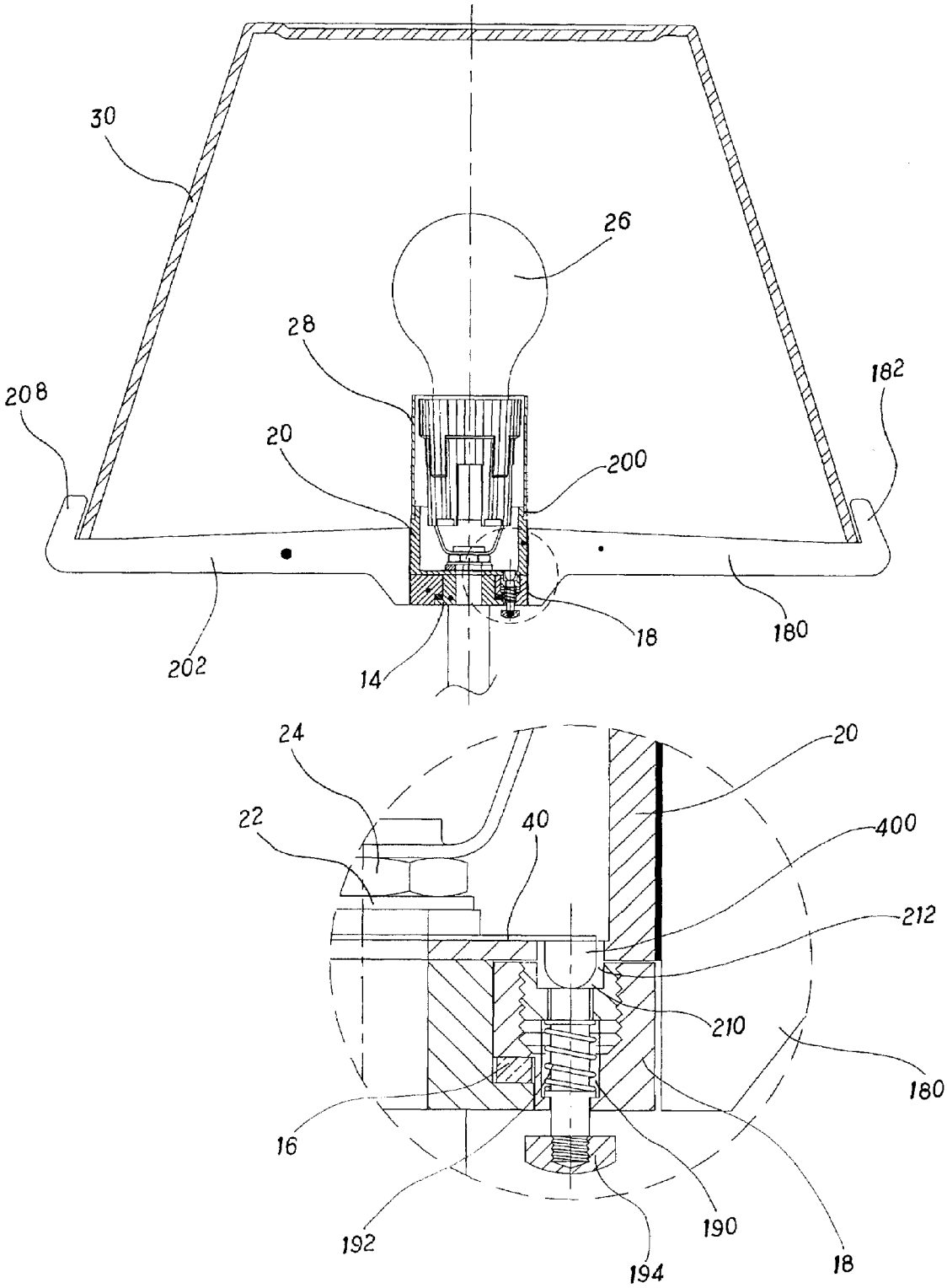
FIG. 12 is an enlarged view that shows a part of the support of the lamp according to a further preferred embodiment of the invention.

Referring to FIG. 12, which shows a rotating structure for folding supports of a lamp according to yet another preferred embodiment of the invention; an elastic plate 40 may be disposed on the fixed axle 20, and the elastic plate 40 has a knob 400 at a front end thereof; the knob 400 is exposed out of the fixed axle 20 from an opening 212 of the fixed axle 20, the elastic plate 40 may be used to replace said ball and said spring and in combination with the rotating axle 18. A through opening 190 is correspondingly disposed to the positioning point 210, and an elastic component 192 is fitted into the through opening 190 with the use of a fixing component 196, the pin 194 is used in combination with the elastic component 192 for pressing against the knob 400, so that the knob 400 may be pushed away from the positioning point 210 via the elasticity of the elastic plate 40, and then the rotating axle 18 may allow the support 180 to rotate therewith.

Figure 13:
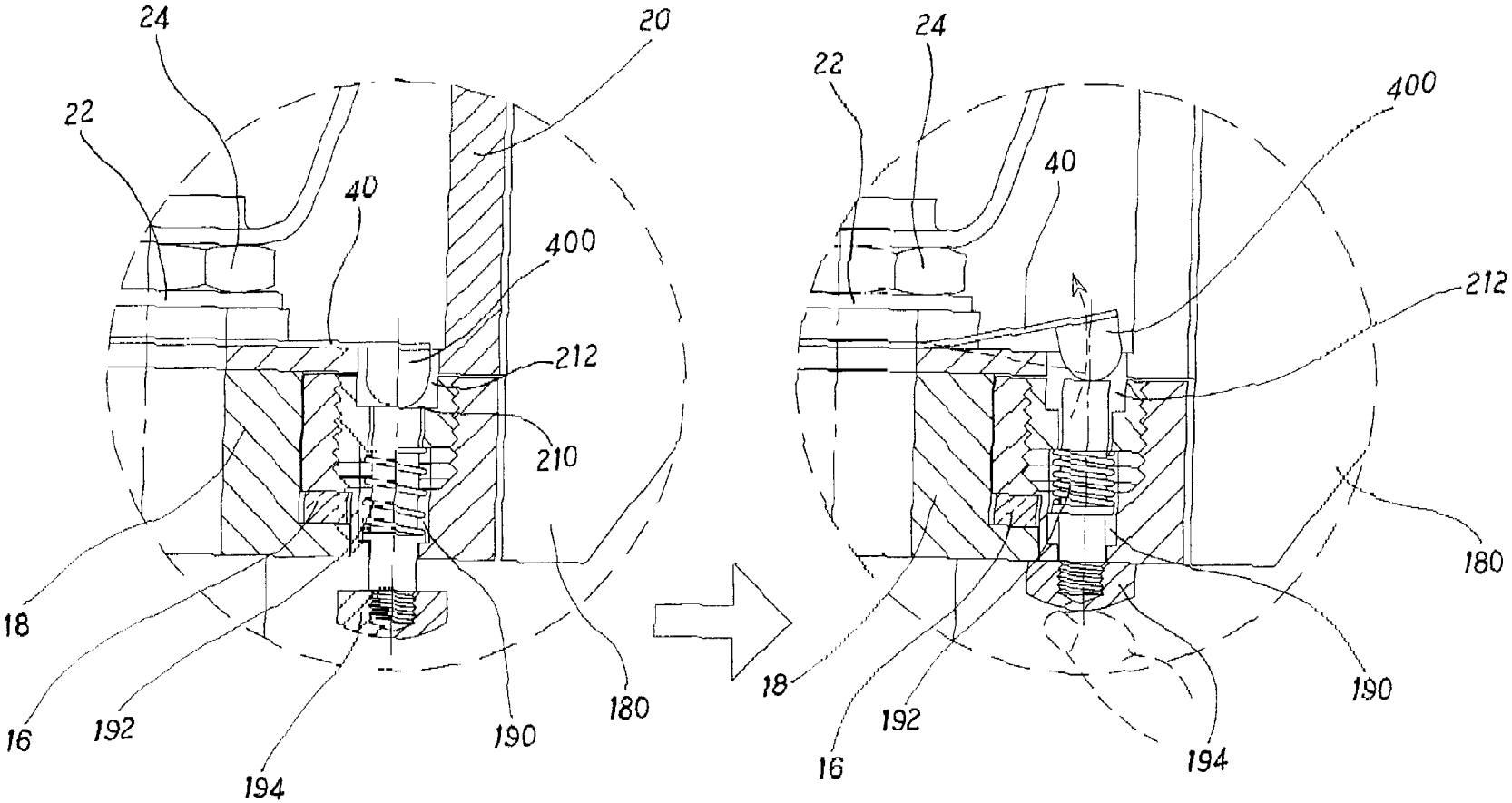
FIG. 13 is an enlarged view that partially shows a support of the lamp being rotated.

Therefore, once the user presses the pin 194 outside of the rotating axle 18, the pin 194 in turn pushes the elastic component 192 in the through opening 190, and the pin 194 also pushes the knob 400 at the same time; because the elastic plate 40 is elastic, the knob 400 is pressed away from the opening 212 and into the fixed axle 20. As a result, the rotating axle 18 becomes free to move, and the rotating axle 18 allows the support 180 to rotate as well, and thus entering the status indicated in FIG. 13.

Although a preferred embodiment of the invention has been described for purposes of illustration, it is understood that various changes and modifications to the described embodiment can be carried out without departing from the scope and the spirit of the invention as disclosed in the appended claims.

What is claimed is:

1. A rotating structure for folding supports of a lamp being able to rotate and positionally move at least a support, comprising:

a rotating axle having at least a support extended therefrom, and a trough with an elastic positioning component disposed therein;

a fixed axle having at least a support extended therefrom, and at least a positioning point;

wherein the rotating axle and the fixed axle joins and forms a joined surface, and the elastic positioning component and the positioning point are disposed within the joined surface; and wherein the elastic positioning component is comprised of a ball and a spring disposed in a trough, and the spring elastically presses against the ball.

2. A rotating structure for folding supports of a lamp being able to rotate and positionally move at least a support, comprising:

a fixed axle having at least a support extended therefrom, and a trough with an elastic positioning component disposed therein;

a rotating axle having at least a support extended therefrom, at least a positioning point, a through opening correspondingly disposed to the positioning point, and an elastic component secured in the through opening with a fixing component;

a pin partially disposed in the through opening of the rotating axle;

wherein the rotating axle and the fixed axle joins and forms a joined surface, and the pin can press against the ball, so that the ball is removed from the positioning point by the pin, and the rotating axle subsequently allows the support to rotate.

3. The rotating structure for folding supports of a lamp of claim 2, wherein when the rotating axle is rotated and thus allows the elastic positioning component to fit into the positioning point, the supports of the lamp may be unfolded.

4. The rotating structure for folding supports of a lamp of claim 2, wherein when the rotating axle is rotated and thus the elastic positioning component is to be removed from the positioning point, the supports of the lamp may be folded together.

5. The rotating structure for folding supports of a lamp of claim 2, wherein the elastic positioning component is comprised of a ball and a spring disposed in a trough, and the spring elastically presses against the ball.

6. The rotating structure for folding supports of a lamp of claim 2, wherein each of the supports has a groove formed thereon for receiving and holding a cover.

7. A rotating structure for folding supports of a lamp being able to rotate and positionally move at least a support, comprising:

a fixed axle having at least a support extended therefrom, and an opening;

an elastic plate having a knob at a front end thereof, and the knob being exposed from the opening of the fixed axle;

a rotating axle having at least a support extended therefrom, at least a positioning point, a through opening correspondingly disposed to the positioning point, and an elastic component secured in the through opening with a fixing component;

a pin partially disposed in the through opening of the rotating axle;

wherein the rotating axle and the fixed axle joins are formed with a joined surface, and the pin can press against the knob of the elastic plate, so that the knob is removed from the positioning point by the pin, and the rotating axle subsequently causes the support to rotate.

8. The rotating structure for folding supports of a lamp of claim 7, wherein when the rotating axle is rotated and thus the knob of the elastic plate is to fit into the positioning point, the supports of the lamp is unfolded.

9. The rotating structure for folding supports of a lamp of claim 7, wherein when the rotating axle is rotated to cause the knob of the elastic plate is to be removed from the positioning point, the supports of the lamp is in a foling state.

10. The rotating structure for folding supports of a lamp of claim 7, wherein each of the supports has a groove disposed thereon for receiving and holding a cover.

* * * * *